US005535299A

United States Patent [19]

Riedel

[11] Patent Number: 5,535,299

[45] Date of Patent: Jul. 9, 1996

[54] ADAPTIVE ERROR CONTROL FOR ADPCM SPEECH CODERS

[75] Inventor: Neal K. Riedel, Encinitas, Calif.

[73] Assignee: Pacific Communication Sciences, Inc., San Diego, Calif.

[21] Appl. No.: 146,612

[22] Filed: Nov. 2, 1993

[51] Int. Cl.[6] ..... G10L 3/02; G10L 9/00

[52] U.S. Cl. ..... 395/2.21; 395/2.37

[58] Field of Search ..... 395/2, 2.1, 2.21, 395/2.23, 2.35, 2.37, 2.36; 381/42, 43

[56] References Cited

U.S. PATENT DOCUMENTS

| | | | |
|---|---|---|---|
| 4,815,137 | 3/1989 | Benvenuto | 381/43 |
| 4,989,246 | 1/1991 | Wan et al. | 381/40 |
| 5,054,073 | 10/1991 | Yazu | 381/37 |
| 5,289,549 | 2/1994 | Rattey et al. | 382/56 |
| 5,347,478 | 9/1994 | Suzuki et al. | 364/715.02 |

OTHER PUBLICATIONS

David J. Goodman et al. in "Waveform Substitution Techniques for Recovering Missing Speech Segments in Packet Voice Communications", *IEEE Transactions on Acoustics, Speech and Signal Processing,* vol. ASSP–34, No. 6, Dec. 1986.

Kiyoshi Yokota, et al. in "A New Missing ATM Cell Reconstruction Scheme for ADPCM–Coded Speech", *Proceedings of the International Conference of Acoustics, Speech, and Signal Processing* 1989.

Cointot and G. de Passoz in "A 60–Channel PCM–ADPCM Converter Robust to Channel Errors", *Proceedings of the International Conference of Acoustics, Speech, and Signal Processing* 1982.

D. Kim and C. K. Un, "An ADPCM System with Improved Error Control", *Proceedings of the International Conference of Acoustics, Speech, and Signal Processing* 1983.

A Speech Processing LSI for ATM Network Subscriber Circuits Shoji et al. IEEE/May 1990.

A New Missing ATM Cell Reconstruction Scheme for ADPCM–Coded Speech Yokota et al IEEE 1982.

A New Speech Processing Scheme for ATM Switching Systems Suzuki et al IEEE/Jun. 1989.

*Primary Examiner*—Allen R. MacDonald
*Assistant Examiner*—Richemond Dorvil
*Attorney, Agent, or Firm*—Martin J. Jaquez; Merle W. Richman, III

[57] ABSTRACT

Methods and apparatus for improving the perceived quality of ADPCM encoded signals by magnitude limiting samples of the ADPCM encoded signals prior to the decoding of samples of the ADPCM encoded signals, preferably, a sample of the ADPCM encoded signal is magnitude limited only if a receive error is detected for the sample.

22 Claims, 4 Drawing Sheets

ADAPTIVE ERROR CONTROL FOR ADPCM SPEECH CODERS

CROSS-REFERENCE TO RELATED APPLICATIONS

This application is related to co-pending application Ser. No. 08/013,625, filed Feb. 2, 1993 (Attorney's Docket No. PACI-0105), which is assigned to the same assignee and is incorporated herein by reference.

FIELD OF THE INVENTION

The present invention relates generally to Adaptive Differential Pulse Code Modulation ("ADPCM") speech coders and more particularly to adaptive error control for ADPCM speech coders.

BACKGROUND OF THE INVENTION

Voice data or signals are commonly compressed and decompressed (encoded and decoded) when they are sent or received by communications applications. A common technique for voice compression or coding is ADPCM. The Consultative Committee in International Telegraphy and Telephony ("CCITT") has adopted a particular ADPCM algorithm known as CCITT standard G.721 for 32 Kbps (bits per second) coding of voice signals which is described in CCITT Recommendation G.721 "32 Kbits/s Adaptive Differential Pulse Code Modulation", CCITT Blue Book, 1988 and which is hereby incorporated by reference for its teachings on the G.721 system. The CCITT standard G.721 was developed for terrestrial wireline applications and provides "toll quality" voice compression and decompression with a minimal processing delay and fairly low complexity provided the communications channel error rates are very low. Generally, terrestrial wireline applications have very low error rates due to an imperfect communications channel, and as such the G.721 system works well with such applications. The CCITT standard G.721, however, has also been adopted for voice compression or coding in wireless communications applications where the error rate may not be as low. For example, the CCITT standard G.721 has been adopted for voice compression or coding for such Personal Communication Services ("PCS") applications as the Japanese Personal Handi-Phone (PHP) and European DECT systems.

The G.721 voice coding system, however, has been found to quickly degrade in communication applications with higher error rates (than wireline applications) such as PCS applications (e.g., the Japanese PHP or the European DECT systems) and in other higher error rate communication applications. It has been found that the perceived voice quality may be reduced even if the error rate is not much higher than the error rate of wireline applications because even a low level of errors due to an imperfect communications channel has been found to produce "clicks" and "pops" caused in a voice signal when the G.721 voice coding system is used. Modifications to ADPCM coding systems to make the systems more robust to channel errors, such as described by Cointot and G. de Passoz in "A 60-Channel PCM-ADPCM Converter Robust to Channel Errors", Proceedings of the International Conference of Acoustics, Speech, and Signal Processing 1982 and by D. Kim and C. K. Un in "ADPCM System with Improved Error Control", Proceedings of the International Conference of Acoustics, Speech, and Signal Processing 1983, are not possible since PCS standards specify that the exact CCITT G.721 standard must be used.

Known techniques to improve the perceived voice quality of systems using the exact G.721 voice coding system include waveform substitution techniques such as those described by David J. Goodman et al. in "Waveform Substitution Techniques for Recovering Missing Speech Segments in Packet Voice Communications", IEEE Transactions on Acoustics, Speech and Signal Processing, Vol. ASSP-34, No. 6, December 1986 and by Kiyoshi Yokota, et al. in "A New Missing ATM Cell Reconstruction Scheme for ADPCM-Coded Speech", Proceedings of the International Conference of Acoustics, Speech, and Signal Processing 1989 which are hereby incorporated by reference. One common waveform substitution technique is known as zero substitution. In this waveform substitution technique, a received voice segment containing errors is replaced with zeros or the ADPCM encoded equivalent of zeros. This technique is also used when an entire voice segment or packet is not received. This waveform substitution technique fails to use the valuable information in the received voice segment with errors since it completely substitutes this segment with zeros.

A second waveform substitution technique is known as last packet substitution. In this waveform substitution technique, a received voice segment containing errors is replaced with the last received voice segment. This technique therefore requires a memory device to store prior received voice segments. This technique has been found to cause mistracking in the ADPCM decoder which produces audible "clicks" in the resultant decoded voice signal.

A third common waveform substitution technique is known as pitch synchronous waveform substitution. In this technique, received voice segments are categorized based on their pitch. When a voice segment with errors is received, its pitch is determined, and then a previously received voice segment which has a similar pitch as the received voice signal with errors is substituted. This system reduces the mistracking and consequently the audible clicks produced by the last packet substitution technique. This technique, however, induces an extremely large increase in the algorithm complexity of the G.721 system. Finally, all of these common waveform substitution techniques fail to use the valuable information in the received voice segment with errors since they completely substitute this segment with either zeros or some previously received voice segment.

It is an object of the present invention to improve the perceived quality of ADPCM encoded signals by using the valuable information in received voice segments with errors by compensating for the actual compression and decompression process used in ADPCM encoders and decoders which produces the audible "clicks" and "pops" in the decoded voice signal when errors are present in received voice segments.

SUMMARY OF THE INVENTION

The previously described problems are overcome and the objects of the invention are achieved in apparatus and methods for adaptive error control for ADPCM speech coders which improve the perceived voice quality of received ADPCM encoded voice signals. The method includes the steps of converting the received ADPCM encoded signal to ADPCM samples and then determining the magnitude of the ADPCM samples. A step of the method then replaces the value of a one ADPCM sample with a first predetermined value if the magnitude of the one ADPCM sample is greater than a second predetermined value. Finally, a step of the method decodes the ADPCM samples using a ADPCM decoder.

Specifically, steps of the method may determine, as a function of the received ADPCM encoded signal, the reliability of the received signal and then replace the value of a one ADPCM sample with a first predetermined value if the magnitude of the one ADPCM sample is greater than a second predetermined value as a function of determined reliability of the corresponding receive signal.

In addition, steps of the method may replace the value of a one ADPCM sample with a first predetermined value if the magnitude of the one ADPCM sample is greater than a second predetermined value and if the determination of the reliability of the corresponding signal indicates that a receiver error was detected.

This method may also include the steps of determining whether a segment of the received signal was missed and then replacing the corresponding ADPCM samples with ADPCM encoded silence if the segment of the received signal was missed.

BRIEF DESCRIPTION OF THE DRAWINGS

The present invention will be better understood, and its numerous objects and advantages will become apparent by reference to the following detailed description of the invention when taken in conjunction with the following drawings, in which.

DETAILED DESCRIPTION

Figure 1:
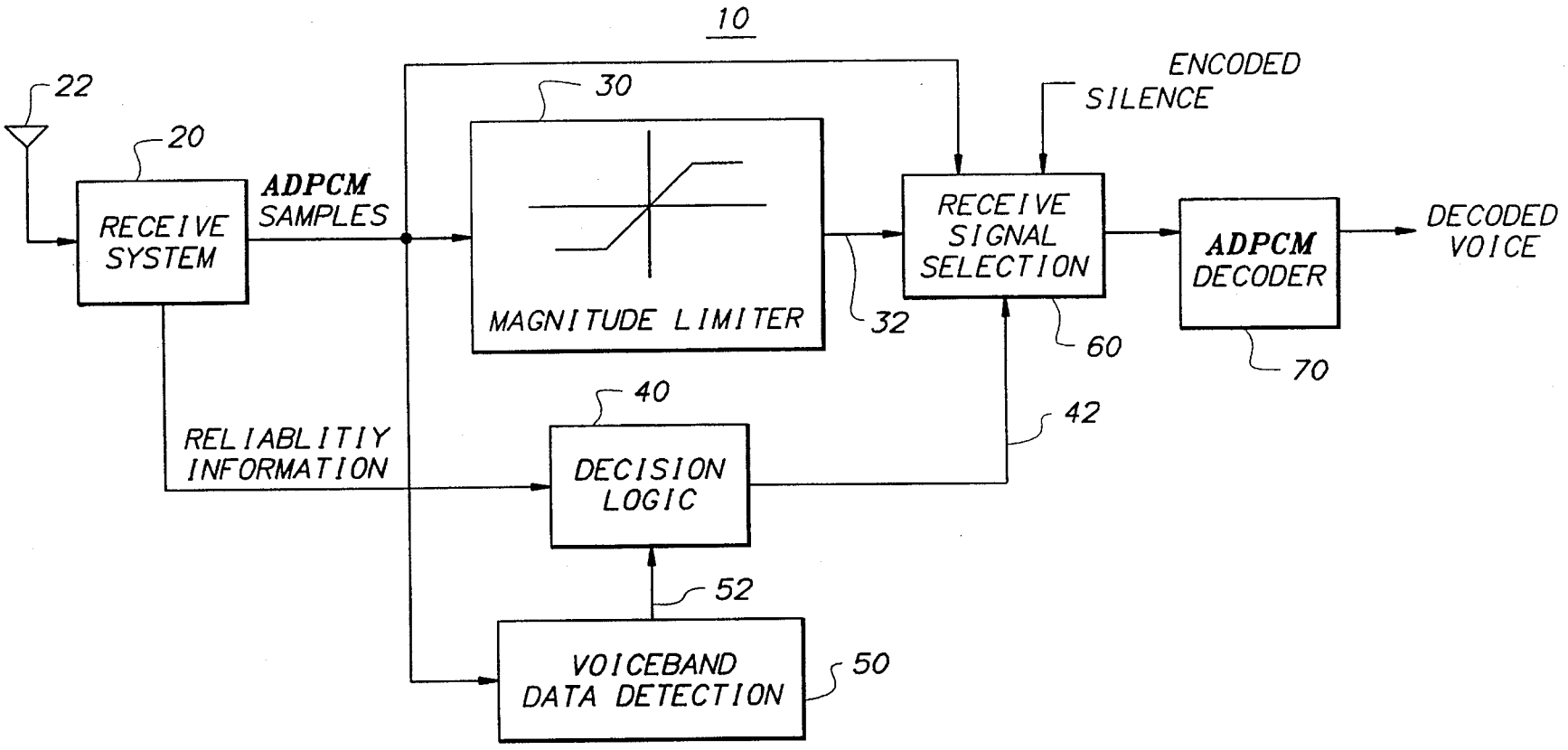
FIG. 1 is a block diagram of exemplary ADPCM voice signal receiver and decoder system constructed in accordance with the present invention.

An exemplary ADPCM receiver and decoder system providing adaptive error control constructed in accordance with the present invention is shown in FIG. 1 and generally designated 10. The system 10 is shown to include an antenna 22, a receive system 20, a magnitude limiter 30, a decision logic unit 40, a voiceband data detection unit 50, a receive signal selection unit 60 and an ADPCM decoder 70. A brief overview of the system 10 is presented and then a detailed description of the operation of each of the components of the system 10 is presented.

A voice signal is received by the antenna 22 and processed by the receive system 20 in voice segments or packets where each voice segment or packet contains ADPCM samples. The receive system 20 generates ADPCM samples from the received voice signal and also reliability information which may include whether a voice segment or packet was missed in the received voice signal or whether errors were detected for the voice segment or packet corresponding to the ADPCM samples produced by the receive system 20.

The magnitude limiter 30 receives the ADPCM samples and produces magnitude-limited ADPCM samples 32 whose magnitude has been limited to some maximum value. The voiceband data detection unit 50 also receives the ADPCM samples and determines whether the data represented by the ADPCM samples is considered to be modem or voiceband data and provides this information 52 to the decision logic unit 40. The decision logic unit 40 receives the reliability information from the receive system 20 and the modem data information 52 from the voiceband data detection unit 50 and as a function of the received information, controls the operation of the receive signal selection unit 60.

In particular, in the preferred embodiment of the invention, the decision logic unit 40 will always instruct the receive signal selection unit 60 to direct the ADPCM samples to the ADPCM decoder 70 if the modem data information 52 indicates that the ADPCM samples represent modem or voiceband data. In addition, if the reliability information from the receive system 20 indicates that no errors were received for the corresponding voice segment and that the voice segment was not missed, the decision logic unit 40 will also instruct the receive signal selection unit 60 to direct the ADPCM samples to the ADPCM decoder 70.

Otherwise, if the reliability information from the receive system 20 indicates that errors were received for the corresponding voice segment and that the voice segment was not missed, the decision logic unit 40 will instruct the receive signal selection unit 60 to direct the magnitude-limited ADPCM samples 32 to the ADPCM decoder 70 or if the reliability information from the receive system 20 indicates that the corresponding voice segment was missed, the decision logic unit 40 will instruct the receive signal selection unit 60 to direct the ADPCM encoded silence to the ADPCM decoder 70.

The receive signal selection unit 60 directs either the ADPCM samples, magnitude-limited ADPCM samples 32, or ADPCM encoded silence to the ADPCM decoder 70 based on the instructions 42 from the decision logic unit 40. Finally, the ADPCM decoder 70, decodes the samples it receives from the receive signal selection unit 60 to generate a decoded voice signal.

In the present invention, magnitude-limited ADPCM samples 32 are selected to replace the ADPCM samples when an error for the corresponding voice segment. It has been found by the inventor that due to the use of short term prediction in the encoding and decoding systems of the CCITT standard G.721 system, replacement of samples with magnitude-limited samples tends to eliminate the audible "clicks" and "pops". The substitution of magnitude-limited samples 32 causes the quantizer scale factor of the decoder to track the long term average energy of the signal while reducing the peaks of the signal. Overall, however, it has been found, that perceived voice quality is not greatly affected by reduction in peaks of a voice signal, while preventing the quantizer scale factor of the decoder from becoming too large due to errors improves the perceived voice quality of the voice signal.

An overview of an encoder and a decoder system is presented to show how the substitution of the magnitude-limited ADPCM samples improves the perceived voice quality of the voice signal by preventing the quantizer scale factor from becoming too large when errors are detected for a voice segment. A more detailed description of the encoder and decoder system of the CCITT standard G.721 is available and described in CCITT Recommendation G.721 "32 Kbits/s Adaptive Differential Pulse Code Modulation", CCITT Blue Book, 1988 which has been incorporated by reference for its teachings on the G.721 system. The overview of an encoder and decoder system for the CCITT G.721 system is presented with reference to FIGS. 2 and 3.

Figure 2:
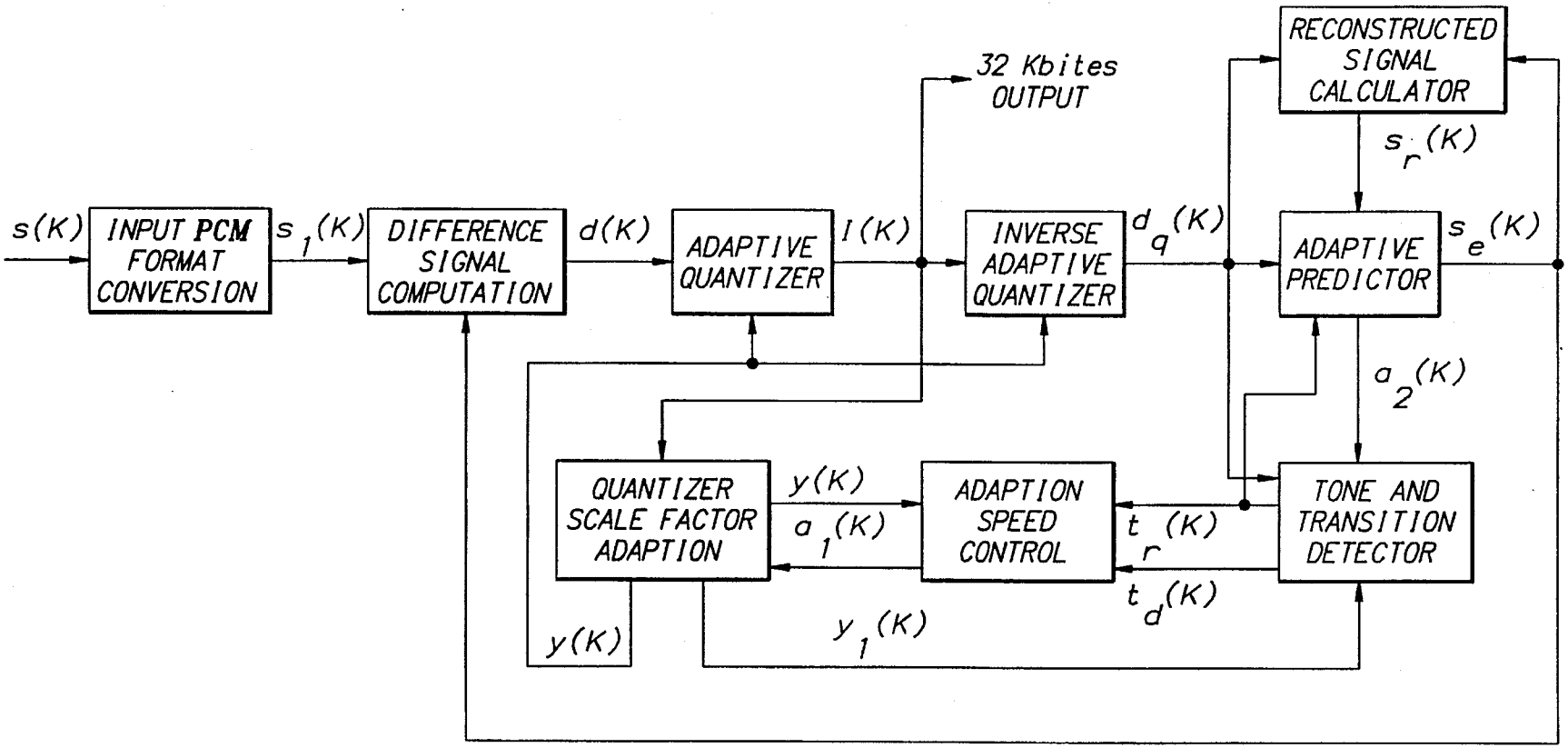
FIG. 2 (PRIOR ART)
FIG. 2 is block diagram of a portion of a CCITT G.721 standard encoder.
Figure 3:
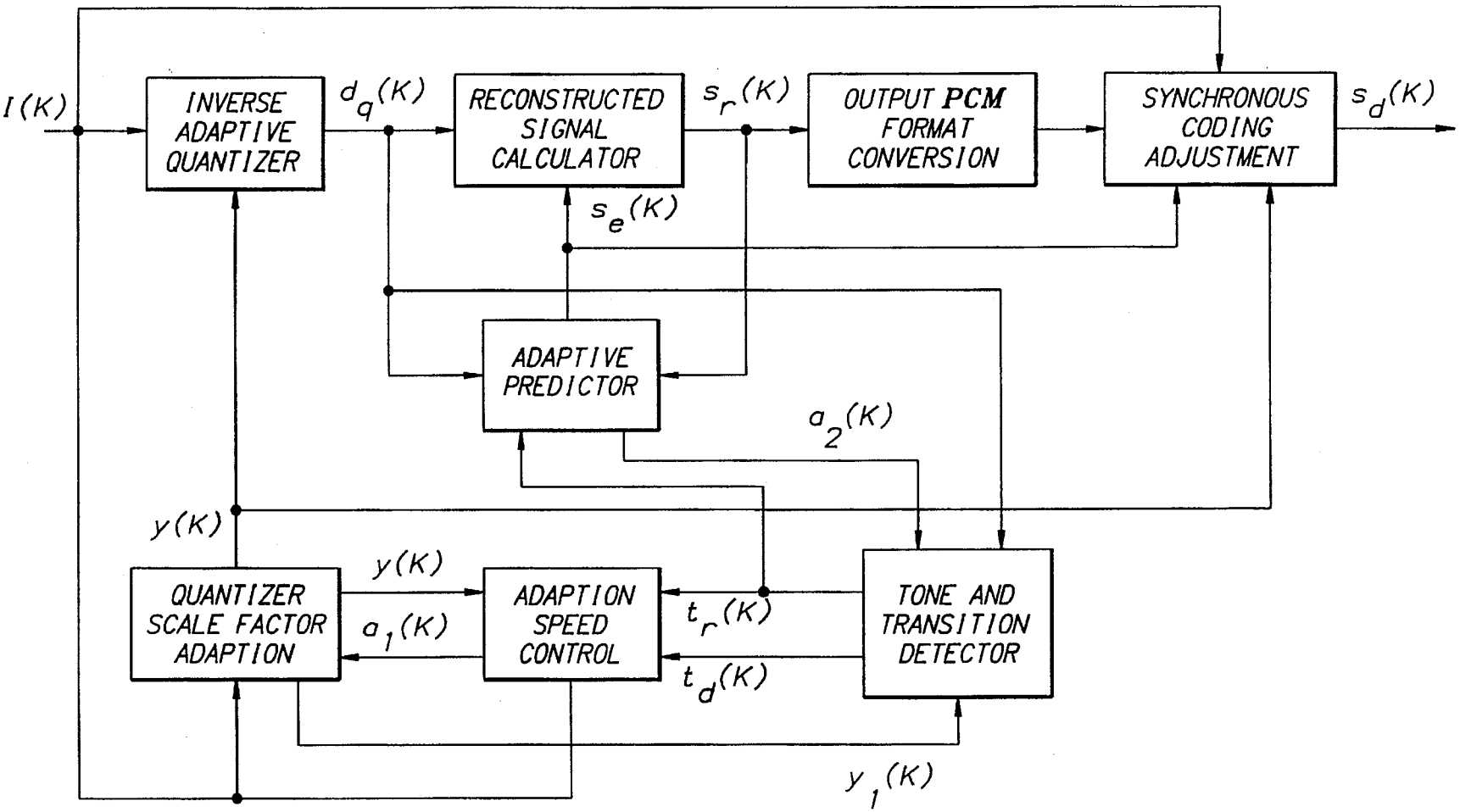
FIG. 3 (PRIOR ART)
FIG. 3 is block diagram of a portion of a CCITT G.721 standard decoder depicted in FIG. 1.

In FIG. 2, a block diagram of a CCITT standard G.721 encoder is shown. In this encoder, the ADPCM samples, I(k) are generated from the quantized difference d(k), of the input voice signal s(k) and the predicted voice signal $s_e(k)$. In particular, the ADPCM samples I(k) are equal to the quantization of the $\log_2$ of the difference signal d(k) less a quantization scale factor y(k) where the quantizer scale factor is adaptively calculated based upon the values of previous ADPCM samples I(k). A block diagram of an CCITT standard G.721 decoder is shown in FIG. 3. As shown in FIG. 3, the decoder, also predicts $s_e(k)$ and uses this value to decode the received ADPCM samples. If the ADPCM samples contains errors, however, the decoder may not be able to accurately predict $s_e(k)$.

Since the ADPCM samples I(k) are generated from the $\log_2$ of the difference signal d(k), less the quantizer scale factor y(k), the quantizer scale factor is effectively a $2^{y(k)}$ scaling factor of the difference signal d(k) and thus the ADPCM samples I(k). It will be shown that the quantizer scale factor y(k) is heavily weighted by ADPCM samples I(k) with large magnitudes and as a consequence when a received voice segment of ADPCM samples has errors, the larger magnitude ADPCM samples tend to cause the decoder, shown in FIG. 3, to fail to match the quantizer scale factor of the encoder, i.e., the decoder and encoder do not generate the same quantization scale factor y(k), the same prediction signal $s_e(k)$ and thus the same voice signal s(k). In particular, the value of y(k) at the decoder tends to become large relative to the value of y(k) at the encoder, and the resultant scaling of ADPCM samples I(k) at the decoder produces a voice signal s(k) with a much larger energy than the voice signal s(k) at the encoder. The result is an audible "click" or "pop".

By substituting magnitude-limited ADPCM samples when errors are received, the quantizer scale factor of the decoder will be forced to track the long term average energy of the voice signal s(k) and thus avoid producing the audible "clicks" and "pops". The substitution does produce smaller peak values in the decoded voice signal, however, as noted above, perceived voice quality is less affected by changes in the peak values than changes in the quantizer scale factor. Thus, by substituting magnitude-limited ADPCM samples even when errors are not received, the perceived voice quality will not be greatly affected and by substituting magnitude-limited ADPCM samples when errors are received, the perceived voice quality of the decoded signal may be improved.

As noted above, the quantizer scale factor y(k) is heavily weighted by ADPCM samples with large magnitudes. This is because the CCITT standard G.721 system y(k) is determined from the a combination of a long term and a short term weighted average of the ADPCM samples I(k), in particular $y(k)=a_L(k)y_u(k-1)+[1-a_L(k)]y_L(k-1)$ where the short term weighted average $y_u(k)=(1-2^{-5})y(k)+2^{-5}W[I(k)]$ and the long term weighted average $y_L(k)=(1-2^{-6})y(k)+2^{-6}y_u(k)$. The function W[] is a weighing function and is equal to 70.13 for ±7, 22.19 for ±6, 12.38 for ±5, 7.00 for ±4, 4.00 for ±3, 2.56 for ±2, 1.13 for ±1, and −0.75 for 0. As a consequence, it can be seen that y(k) is heavily weighted by ADPCM samples I(k) having magnitudes greater than 4 by the weighing function W[]. The quantizer scale factor y(k) is also effected by the value of the adaption speed control parameter $a_L(k)$. The adaption speed control parameter $a_L(k)$ determines whether the quantizer scale factor y(k) should more closely follow the short term or long term average of the quantizer scale factor y(k).

By limiting the magnitude of the ADPCM samples I(k) at the input of the decoder, the quantizer scale factor y(k) is more likely to track the long term average of energy of the voice signal s(k) at the encoder and thus reduce or eliminate the presence of audible "clicks" or "pops" in the voice signal s(k) produced at the decoder. With this understanding of the operation of the encoder and decoder of the CCITT standard G.721 system, a detailed description of the components of the system 10 of the invention is presented with reference again to FIG. 1.

In the exemplary embodiment of the invention, the encoded ADPCM samples I(k) are modulated and sent over a wireless communication channel. The modulated ADPCM samples I(k) are received in segments or packets by the antenna 22. The receive system 20 receives the modulated ADPCM samples I(k) in packet form and generates digital ADPCM samples I(k). Ideally, if the communications channel were error free, the digital ADPCM samples I(k) would be equivalent to the ADPCM samples I(k) generated by the encoder prior to modulation, transmission and reception by the antenna 22. Since communications channels are not generally error free, in the preferred embodiment of the invention, the receive system 20 also provides reliability information which includes whether a voice segment or packet was missed in the received voice signal or whether errors were detected for the voice segment or packet corresponding to the ADPCM samples produced by the receive system 20. An exemplary receive system is described in detail in the cross-referenced co-pending application Ser. No. 08/013,625, filed Feb. 2, 1993 (Attorney's Docket No. PACI-0105).

In the exemplary embodiment of the invention, the magnitude limiter 30 receives the ADPCM samples generated by the receive system 20 and produces magnitude-limited ADPCM samples 32 whose magnitude has been limited to some maximum value, i.e., if the magnitude of I(k) is greater than some first predetermined value A, then the magnitude of I(k) is set equal to a second predetermined value B, while the sign of I(k) remains constant. In the preferred embodiment of the invention, the value of A is set to 4 and B is set to 4, so that if I(k) is greater than 4, then I(k) is set to 4, and if I(k) is less than −4, then I(k) is set to −4. The magnitude-limited ADPCM samples 32 are passed to the receive signal selection unit 60.

The voiceband data detection unit 50 also receives the ADPCM samples generated by the receive system 20 and determines whether the data represented by the ADPCM samples is modem or voiceband data. The voiceband data detection unit 50 then provides this information 52 to the decision logic unit 40. One embodiment of the voiceband data detection unit 50 is described with reference to FIG. 4. In this embodiment of the invention, the system is a full duplex system where one signal is received on the communications channel by a communications application while another signal is being transmitted by the same communications application. Since the purpose of the voiceband data detection unit 50 is to determine whether the received ADPCM samples represent modem or voiceband data, in a full duplex channel, the voiceband data detection unit 50 may use transmission information of the encoder 80 to determine whether the receive signal represents modem or voiceband data since if a communications application is transmitting modem or voiceband data, it is generally also receiving modem or voiceband data.

Figure 4:
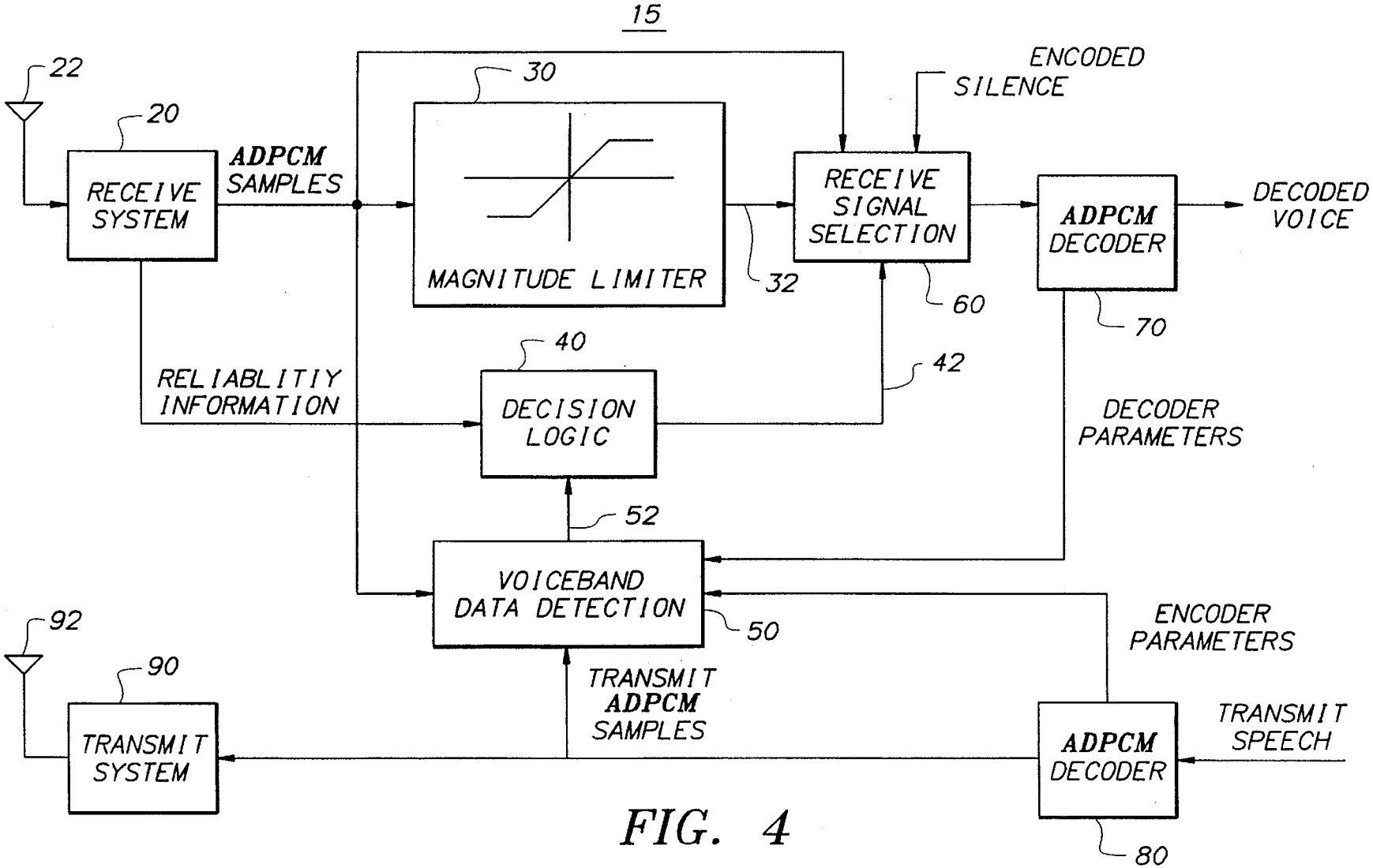
FIG. 4 is a block diagram of exemplary ADPCM duplex system constructed in accordance with the present invention.

The system 15 in FIG. 4 further includes an antenna 92 for transmitting modulated ADPCM samples generated by ADPCM encoder 80 and modulated by the transmit system 90. Reference is again made to the cross-referenced co-pending application Ser. No. 08/013,625, filed Feb. 2, 1993

(Attorney's Docket No. PACI-0105) for its teachings on transmit systems. In the system 15 shown in FIG. 4, the voiceband data detection unit may receive system parameters, in particular, the quantization scale factor y(k) of the encoder 80 or the decoder 70 and the second order predictor coefficient $a_1(k)$ of the decoder 70, or ADPCM samples from the receive system 20 or from the ADPCM encoder 80.

In one exemplary embodiment of the invention, the voiceband data detection unit 50 determines whether the ADPCM samples I(k) contains modem or voiceband data as a function of the quantization scale factor y(k) of either the encoder 80 or decoder 90 for the last previously transmitted or received voice segment and a second order predictor coefficient $a_1(k)$ for the decoder 70. In this embodiment, if a data detection variable D is less a threshold, TD, or the second order predictor coefficient $a_1(k)$ is less then a threshold, TA, then the ADPCM samples I(k) are not deemed to contain modem or voiceband data. Otherwise, the ADPCM samples I(k) are deemed to contain modem or voiceband data. The determination of whether the ADPCM samples represent modem or voiceband data is then supplied to the decision logic unit 40.

In the exemplary embodiment of the invention, $D=D*(1-\alpha)+INCR$ if y(k) of the encoder 80 or decoder 70 is greater than TY (which is set to 3.0 in the preferred embodiment of the invention), else $D=D*(1-\alpha)-DECR$. If D is less than 0, however, D is set to 0. In the preferred embodiment of the invention, $\alpha=1/512$, INCR=1, and DECR=–5. In the preferred embodiment of the invention, a voice segment is received every 5 milliseconds. As a consequence, D is updated at every 5 milliseconds and thus the time constant for this indicator is about 2 seconds, i.e., about 512*5 milliseconds.

If energy is constantly present in the signal, as with modem or voiceband data signals, D, which in the preferred embodiment of the invention is a fixed point variable with 5 bit fractional part and a 10 bit magnitude, will quickly reach its maximum of 512.0 (based on the time constant in about 2 seconds). In the preferred embodiment of the invention, TD is set to 75% of the maximum of D, or 384.0. The voiceband data detection unit 50 also checks the value of the second order predictor coefficient $a_1(k)$.

The voiceband data detection unit checks the value of the second order predictor coefficient $a_1(k)$ to determine whether constant tones are present which will also have constant energy but not represent modem or voiceband data, one such constant tone is a dial tone. If the second order predictor coefficient $a_1(k)$ is greater than the threshold, TA, in the preferred embodiment of the invention, TA=1.25, then a constant tone is considered to be present in the ADPCM samples I(k) and modem information signal 52 will indicate that no modem or voiceband data is present in the ADPCM samples.

In the system 15, if the internal value of the encoder's and decoder's y(k) and the decoder's second order predictor coefficient $a_1(k)$ are not available, then a different system is used to determine whether the ADPCM samples I(k) contain modem or voiceband data. In the exemplary embodiment of the invention, these values may not be available because a stock or standard CCITT standard G.721 decoder and encoder is used.

If the internal variables are not available, then voiceband data detection unit 50 determines a $y_d(k)$ using the received ADPCM samples and a $y_e(k)$ (if available) using the ADPCM samples generated by the ADPCM encoder 80. The factors $y_d(k)$ and $y_e(k)$ are determined by using the same function used by the CCITT standard G.721 decoder and encoder to determine the short term quantizer scale factor $y_u(k)$. Thus, $y_d(k)=(1-2^{-5})y_d(k)=(1-2^{-5})u_d(k)+2^{-5}W[I(k)]$ and $y_e(k)=(1-2^{-5})y_e(k)+2^{-5}W[I(k)]$ where W[] is equal to 70.13 for ±7, 22.19 for ±6, 12.38 for ±5, 7.00 for ±4, 4.00 for ±3, 2.56 for ±2, 1.13 for ±1, and –0.75 for 0. Then $y_d(k)$ and $y_e(k)$ are used to determine D as above by replacing the y(k) for the encoder with $y_e(k)$ and y(k) for the decoder with $y_d(k)$. In addition, since the second order predictor coefficient $a_1(k)$ is not available, this part of the system is not used. In detail, $D=D*(1-\alpha)+INCR$ if $y_d(k)$ or $y_e(k)$ is greater than TY, else $D=D*(1-\alpha)-DECR$. If D is less than 0, however, D is set to 0. Then, if the data detection variable D is less the threshold TD, then the ADPCM samples I(k) are deemed not to contain modem or voiceband data. Otherwise, the ADPCM samples I(k) are deemed to contain modem or voiceband data and regardless this information 52 is supplied to the decision logic unit 50. A final embodiment of the voiceband data detection unit is shown in FIG. 1. In this unit, data generated by an encoder is not available and the internal variables y(k) and $a_1(k)$ are not available because the decoder 70 is a standard or stock CCITT standard G.721 decoder. The voiceband data detection unit 50 functions the same as the unit in the previous embodiment except that $y_e(k)$ is not determined and thus whether D is over the threshold is determined only as a function of $y_d(k)$. In each of the above embodiments of the voiceband data detection units 50, the unit 50 generates the modem data information signal 52 which indicates whether or not the ADPCM samples are considered to represent modem or voiceband data.

The decision logic unit 52 receives the reliability information from the receive system 20 and the modem data information signal 52 from the voiceband data detection unit 50 and as a function of the received information, controls the operation of the receive signal selection unit 60.

In particular, as noted above, in the preferred embodiment of the invention, the decision logic unit 40 instructs the receive signal selection unit 60 to direct the ADPCM samples to the ADPCM decoder 70 if the modem data information 52 indicates that the ADPCM samples represent modem data. This is necessary because the modem data would be adversely affected if the ADPCM samples I(k) representing the modem data were substituted with the magnitude-limited ADPCM samples 32.

If the reliability information from the receive system 20 indicates that no errors were received for the corresponding voice segment and that the voice segment was not missed, the decision logic unit 40 may instruct the receive signal selection unit 60 to direct the ADPCM samples to the ADPCM decoder 70. If magnitude-limited ADPCM samples 32 replace the ADPCM samples I(k) even when no errors are detected, the quality of the decoded signal may not be significantly degraded since the periodicity of the voice signal would still be maintained. In the preferred embodiment of the invention, the receive signal selection unit 60 is only instructed to substitute ADPCM samples I(k) with magnitude-limited samples 32 when errors are detected in the corresponding voice segment.

If the reliability information from the receive system 20 indicates that the corresponding voice segment was missed, the decision logic unit 40 will instruct the receive signal selection unit 60 to direct the ADPCM encoded silence to the ADPCM decoder 70. In this case, the ADPCM samples do not contain any valuable information since the voice segment was missed. The receive signal selection unit 60, in this case, then would replace the ADPCM samples I(k) with encoded silence. In the CCITT standard G.721 system, encoded silence for a sample is 0 Fh.

Based on the instruction signal 42 from the decision logic unit 40, the receive signal selection unit 60 directs either the ADPCM samples I(k), magnitude-limited ADPCM samples 32, or ADPCM encoded silence (0 Fh) to the ADPCM decoder 70. In the preferred embodiment of the invention, this determination and instruction 42 is only generated once for every voice segment and thus for the corresponding ADPCM samples I(k). Depending on the reliability information from the receive system 20 or the change in data type from modem data to speech, this determination may be performed more than once per voice segment.

Finally, the ADPCM decoder, decodes the data it receives from the receive signal selection unit 60 to generate a decoded voice signal. In this exemplary embodiment of the invention, the ADPCM decoder is a standard or stock CCITT standard G.721 decoder so that no special modifications are necessary to implement the present invention with standard encoders and decoders. In the preferred embodiment of the invention, the ADPCM coders have the capability of providing system parameters to eternal devices such as the voiceband data detection unit 50.

While the invention has been described and illustrated with reference to specific embodiments, those skilled in the art will recognize that modifications and variations may be made without departing from the principles of the invention as described hereinabove and set forth in the following claims.

What is claimed is:

1. A method of improving a perceived voice quality of an ADPCM encoded signal having segments received from an imperfect communications channel, said method comprising the steps of:

a) converting a received segment of the ADPCM encoded signal to ADPCM samples;

b) determining the magnitude of the ADPCM samples;

c) replacing the value of a one ADPCM sample with a first predetermined value if the magnitude of the one ADPCM sample is greater than a second predetermined value, the magnitude of the first predetermined value being greater than zero; and d) after step c), decoding the ADPCM samples using a ADPCM decoder.

2. A method according to claim 1, wherein step c) comprises:

i) determining, as a function of the received segment of the ADPCM encoded signal, reliability of the received segment; and ii) replacing the value of a one ADPCM sample with a first predetermined value if the magnitude of the one ADPCM sample is greater than a second predetermined value as a function of determined reliability of the corresponding received segment of the ADPCM encoded signal, the magnitude of the first predetermined value being greater than zero.

3. A method according to claim 2, wherein step ii) comprises:

replacing the value of a one ADPCM sample with a first predetermined value if the magnitude of the one ADPCM sample is greater than a second predetermined value and the determination of the reliability of the corresponding segment of the ADPCM encoded signal indicates that a received signal error was detected for the received segment.

4. A method according to claim 3, said method further comprising the steps of:

determining whether the received segment of the ADPCM encoded signal was missed; and replacing the corresponding ADPCM samples with ADPCM encoded silence if the received segment of the ADPCM encoded signal was missed.

5. A method according to claim 1, wherein step c) comprises:

i) determining, as a function of the received segment of the ADPCM encoded signal, whether the received segment is modem or voiceband data; and ii) replacing the value of a one ADPCM sample with a first predetermined value if the magnitude of the one ADPCM sample is greater than a second predetermined value and the received segment was not determined to be modem or voiceband data, the magnitude of the first predetermined value being greater than zero.

6. A method according to claim 5, wherein step i) comprises:

determining, as a function of system parameters of the decoder, whether the received segment is modem or voiceband data.

7. A method according to claim 5, wherein step i) comprises:

determining, as a function of system parameters of the decoder and an encoder, whether the received segment is modem or voiceband data.

8. A method according to claim 5, wherein step i) comprises:

determining, as a function of transmitted segments of an ADPCM encoded signal of an encoder, whether the received segment is modem or voiceband data.

9. A method according to claim 5, wherein step ii) comprises:

iii) determining, as a function of the received segment of the ADPCM encoded signal, reliability of the received segment; and iv) replacing the value of a one ADPCM sample with a first predetermined value if the magnitude of the one ADPCM sample is greater than a second predetermined value and the received segment was not determined to be modem or voiceband data as a function of determined reliability of the corresponding received segment of the ADPCM encoded signal, the magnitude of the first predetermined value being greater than zero.

10. A method according to claim 9, wherein step iv) comprises:

replacing the value of a one ADPCM sample with a first predetermined value if the magnitude of the one ADPCM sample is greater than a second predetermined value, the received segment was not determined to be modem or voiceband data, and the determination of the reliability of the corresponding segment of the ADPCM encoded signal indicates that a received signal error was detected for the received segment, the magnitude of the first predetermined value being greater than zero.

11. A method according to claim 10, said method further comprising the steps of:

determining whether the received segment of the ADPCM encoded signal was missed; and replacing the corresponding ADPCM samples with ADPCM encoded silence if the received segment of the ADPCM encoded signal was missed.

12. An apparatus for improving a perceived voice quality of an ADPCM encoded signal having segments received from an imperfect communications channel, said apparatus comprising:

means for converting a received segment of the ADPCM encoded signal to ADPCM samples;

means for determining the magnitude of the ADPCM samples;

replacement means for replacing the value of a one ADPCM sample with a first predetermined value if the magnitude of the one ADPCM sample is greater than a second predetermined value, the magnitude of the first predetermined value being greater than zero; and an ADPCM decoder, the decoder decoding ADPCM samples after processing by the replacement means.

13. An apparatus according to claim 12, wherein said replacement means includes:

means for determining, as a function of the received segment of the ADPCM encoded signal, reliability of the received segment; and reliability replacement means for replacing the value of a one ADPCM sample with a first predetermined value if the magnitude of the one ADPCM sample is greater than a second predetermined value as a function of determined reliability of the corresponding received segment of the ADPCM encoded signal, the magnitude of the first predetermined value being greater than zero.

14. An apparatus according to claim 13, wherein said reliability replacement means includes:

means for replacing the value of a one ADPCM sample with a first predetermined value if the magnitude of the one ADPCM sample is greater than a second predetermined value and the determination of the reliability of the corresponding segment of the ADPCM encoded signal indicates that a received signal error was detected for the received segment.

15. An apparatus according to claim 14, said apparatus further comprising:

means for determining whether the received segment of the ADPCM encoded signal was missed; and means for replacing the corresponding ADPCM samples with ADPCM encoded silence if the received segment of the ADPCM encoded signal was missed.

16. An apparatus according to claim 12, wherein said replacement means includes:

voiceband determination means for determining, as a function of the received segment of the ADPCM encoded signal, whether the received segment is modem or voiceband data; and voiceband replacement means for replacing the value of a one ADPCM sample with a first predetermined value if the magnitude of the one ADPCM sample is greater than a second predetermined value and the received segment was not determined to be modem or voiceband data, the magnitude of the first predetermined value being greater than zero.

17. An apparatus according to claim 16, wherein said voiceband determination means includes:

means for determining, as a function of system parameters of the decoder, whether the received segment is modem or voiceband data.

18. An apparatus according to claim 16, wherein said voiceband determination means includes:

means for determining, as a function of system parameters of the decoder and an encoder, whether the received segment is modem or voiceband data.

19. An apparatus according to claim 16, wherein said voiceband determination means includes:

means for determining, as a function of transmitted segments of an ADPCM encoded signal of an encoder, whether the received segment is modem or voiceband data.

20. An apparatus according to claim 19, wherein said voiceband replacement means includes:

means for determining, as a function of the received segment of the ADPCM encoded signal, reliability of the received segment; and reliability voiceband replacement means for replacing the value of a one ADPCM sample with a first predetermined value if the magnitude of the one ADPCM sample is greater than a second predetermined value and the received segment was not determined to be modem or voiceband data as a function of determined reliability of the corresponding received segment of the ADPCM encoded signal, the magnitude of the first predetermined value being greater than zero.

21. An apparatus according to claim 20, wherein said reliability voiceband replacement means includes:

means for replacing the value of a one ADPCM sample with a first predetermined value if the magnitude of the one ADPCM sample is greater than a second predetermined value, the received segment was not determined to be modem or voiceband data, and the determination of the reliability of the corresponding segment of the ADPCM encoded signal indicates that a received signal error was detected for the received segment, the magnitude of the first predetermined value being greater than zero.

22. An apparatus according to claim 21, said apparatus further comprising:

means for determining whether the received segment of the ADPCM encoded signal was missed; and means for replacing the corresponding ADPCM samples with ADPCM encoded silence if the received segment of the ADPCM encoded signal was missed.

* * * * *